US010426189B2

(12) United States Patent
Nishimura et al.

(10) Patent No.: US 10,426,189 B2
(45) Date of Patent: Oct. 1, 2019

(54) METHOD OF MANUFACTURING CUT STEM, CUT STEM MANUFACTURING APPARATUS, AND CUT STEM

(71) Applicant: JAPAN TOBACCO INC., Tokyo (JP)

(72) Inventors: Manabu Nishimura, Tokyo (JP); Susumu Abe, Tokyo (JP); Satoshi Taguchi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 1497 days.

(21) Appl. No.: 14/038,444

(22) Filed: Sep. 26, 2013

(65) Prior Publication Data

US 2014/0020695 A1 Jan. 23, 2014

Related U.S. Application Data

(63) Continuation of application No. PCT/JP2011/057869, filed on Mar. 29, 2011.

(51) Int. Cl.

| | |
|---|---|
| ***A24B 5/16*** | (2006.01) |
| ***A24B 3/18*** | (2006.01) |
| ***A24B 7/00*** | (2006.01) |
| ***A24B 13/02*** | (2006.01) |

(52) U.S. Cl.

CPC ..... *A24B 5/16* (2013.01); *A24B 3/18* (2013.01); *A24B 7/00* (2013.01); *A24B 13/02* (2013.01)

(58) Field of Classification Search

CPC ..... A24F 5/04

See application file for complete search history.

(56) References Cited

U.S. PATENT DOCUMENTS

| | | | | |
|---|---|---|---|---|
| 3,204,641 A * | 9/1965 | O'Brien | A24B 5/16 131/291 |
| 3,409,022 A | 11/1968 | De La Burdé | |
| 3,556,112 A | 1/1971 | Dela Burde et al. | |
| 4,076,030 A | 2/1978 | Smith | |
| 4,211,243 A | 7/1980 | Ohno et al. | |
| 4,300,579 A | 11/1981 | Ulrich | |
| 4,366,824 A * | 1/1983 | Rainer | A24B 5/16 131/291 |
| 4,386,617 A * | 6/1983 | Brackmann | A24B 5/16 131/290 |

(Continued)

FOREIGN PATENT DOCUMENTS

| | | |
|---|---|---|
| CN | 1404365 A | 3/2003 |
| CN | 101371719 A | 2/2009 |

(Continued)

OTHER PUBLICATIONS

Office Action issued in corresponding Chinese Patent Application No. 201180071274.4 dated Mar. 29, 2016 (with English translation).

(Continued)

*Primary Examiner* — Cynthia Szewczyk

(74) *Attorney, Agent, or Firm* — Birch, Stewart, Kolasch & Birch, LLP

(57) ABSTRACT

Method of manufacturing a cut stem with increased filling capacity comprises tearing a rod-like stem material having a water content of 20 to 50% by weight, shredding the torn rod-like stem material, and subjecting the rod-like cut stem material to expansion treatment.

6 Claims, 3 Drawing Sheets

(56) References Cited

U.S. PATENT DOCUMENTS

| | | | | | |
|---|---|---|---|---|---|
| 4,388,933 | A * | 6/1983 | Rainer | A24B 3/182 131/293 |
| 4,702,264 | A | 10/1987 | Graves, Jr. | |
| 5,564,444 | A * | 10/1996 | Naylor | A24B 5/16 131/290 |
| 2003/0010348 | A1 | 1/2003 | Takase et al. | |
| 2014/0137882 | A1* | 5/2014 | De Borst | A24B 13/00 131/352 |

FOREIGN PATENT DOCUMENTS

| | | | |
|---|---|---|---|
| CN | 101596014 | A | 12/2009 |
| CN | 101611923 | A | 12/2009 |
| CN | 101708064 | A | 5/2010 |
| JP | 46-8440 | B1 | 3/1971 |
| JP | 56-1903 | B2 | 1/1981 |
| JP | 60-54030 | B2 | 11/1985 |
| JP | 62-289167 | A | 12/1987 |
| JP | 63-102661 | A | 5/1988 |
| WO | WO 94/04340 | A1 | 3/1994 |
| WO | WO 94/10864 | A1 | 5/1994 |

OTHER PUBLICATIONS

Office Action issued in Chinese Patent Application No. 201180071274.4, dated Jul. 27, 2015.

R.J. Reynolds Tobacco Company, "Specifications for Cut Rolled Expanded Stems," Issued Aug. 20, 1993, revised Nov. 16, 1993 and revised on Dec. 10, 1993 (15 pages).

Chinese Office Action for Chinese Application No. 201180071274.4, dated Oct. 14, 2016, with an English translation.

U.S. Office Action for U.S. Appl. No. 15/186,047, dated Oct. 6, 2016.

Chinese Office Action and Search Report, dated Apr. 19, 2017, for Chinese Application No. 201180071274.4, with English translations.

Dewitt et al., "Evidence for a Plasma Membrane Proton Pump in Phloem Cells of Higher Plants," The Plant Journal. vol. 1, No. 1, 1991, pp. 121-128.

U.S. Office Action, dated Apr. 28, 2017, for U.S. Appl. No. 15/186,047.

European Office Action dated Apr. 18, 2018 for Application No. 11 862 597.9.

U.S. Office Action dated Jun. 14, 2018 for U.S. Appl. No. 15/186,047.

European Office Action, dated Apr. 16, 2019, for European Application No. 11862597.9.

* cited by examiner

METHOD OF MANUFACTURING CUT STEM, CUT STEM MANUFACTURING APPARATUS, AND CUT STEM

CROSS REFERENCE TO RELATED APPLICATIONS

This application is a Continuation Application of PCT Application No. PCT/JP2011/057869, filed Mar. 29, 2011, the entire contents of which are incorporated herein by reference.

BACKGROUND OF THE INVENTION

1. Field of the Invention

The present invention relates to a method of manufacturing cut stem, a cut stem manufacturing apparatus, and cut stem.

2. Description of the Related Art

Rod-like stems are separated from tobacco leaves, and include internal tissues and an integument existing on a surface of the internal tissues. The rod-like stems occupy 20 to 30% by weight of tobacco leaves. Rod-like cut stems (cut stems) are used for cut tobacco together with cut lamina, from which stems has been removed, for the purpose of effective use of tobacco material. Cut stems are generally obtained by rolling and shredding rod-like stem material. The cut stems are further subjected to an expansion treatment by drying, to increase filling capacity and combustibility and ease the flavor.

In a conventional method of manufacturing cut stems, first, rod-like stem material is subjected to rolling treatment to reduce the thickness thereof, and then subjected to shredding treatment. The rolling treatment reduces sparseness and density of the rod-like stem material at the inlet of the cutter, and facilitates shredding by the cutter. Next, cut stems having predetermined filling capacity is manufactured by expansion treatment involving humidification and drying the rod-like cut stem material.

U.S. Pat. No. 4,300,579 Nov. 17, 1981, discloses that wet rod-like stem material is subjected to rolling treatment, and thereafter at least one horizontal cutting is performed in an axial direction before shredding treatment. This cutting makes the length and thickness of the rod-like stem material uniform. In addition, breakage of fibers can be suppressed to the minimum. The rod-like cut stem material is further subjected to shredding and expansion treatment, and thereby its filling capacity is improved.

BRIEF SUMMARY OF THE INVENTION

In the former method, however, there is a limit to reducing the thickness of the rod-like stem material. In addition, the spreading treatment only crushes the rod-like stem material, and the surface of the rod-like stem material is still covered with a hard epidermis. As a result, it is difficult to obtain cut stems with high filling capacity even if the rod-like stem material is subjected to shredding and expansion treatments after rolling. In addition, the expanded cut stems have a width greater than that of cut lamina used for tobacco shreds.

Further, in the latter method, the rod-like stem material includes curved stems or long stems (for example, having a length exceeding 20 cm), and thus it is not practical to successively cut the rod-like stem material in an axial direction.

An object of the present invention is to provide cut stems with increased filling capacity.

The present invention provides a method which enables manufacturing of cut stems with increased filling capacity.

According to a first aspect of the present invention, there is provided a cut stem comprising: spongy fiber tissue derived from internal tissue, which includes an integument existing on a part of a surface thereof; and fluffy fibers formed on at least part of the surface of the spongy fiber tissue excluding the integument.

According to a second aspect of the present invention, there is provided a cut stem manufacturing method comprising: tearing a rod-like stem material having a water content of 20 to 50% by weight;

shredding the torn rod-like stem material; and subjecting the rod-like cut stem material to expansion treatment.

According to a third aspect of the present invention, there is provided a cut stem manufacturing apparatus comprising: first and second rollers which include outer peripheral surfaces opposed to each other with a fixed space therebetween, and include axes arranged horizontally or almost horizontally, the first and second rollers rotating in a feed direction, the first roller rotating at a peripheral velocity greater than a peripheral velocity of the second roller;

a material supplying device to supply a rod-like stem material with a water content of 20 to 50% by weight from above to a space between the first and second rollers;

a cutter which shreds the rod-like stem material fed from the first and second rollers; and expansion means configured to expand the rod-like cut stem material.

In the above description, the term "space" between the first and second rollers indicates a distance between their outer peripheral surfaces, when the outer peripheral surfaces of the first and second rollers are flattened or the outer peripheral surfaces are provided with a plurality of grooves along an axial direction thereof. The term "space" indicates a distance between a top of cogs of the first and second rollers, when the outer peripheral surfaces of the first and second rollers are provided with a plurality of cogs along the axial direction thereof.

DETAILED DESCRIPTION OF THE INVENTION

Embodiments of the present invention will be explained hereinafter in detail.

A cut stem according to an embodiment includes a spongy fiber tissue derived from internal tissue, which includes an integument existing on a part of a surface thereof, and fluffy fibers formed on at least part of the surface of the fiber tissue excluding the integument.

Figure 1:
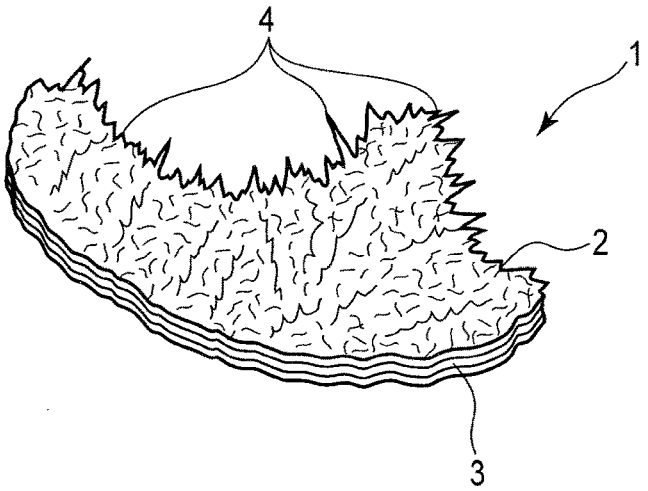
FIG. 1 is a schematic perspective view of a cut stem according to an embodiment.

FIG. 1 illustrates a specific cut stem. A cut stem 1 includes a spongy fiber tissue 2 derived from internal tissue. The spongy fiber tissue 2 includes an integument 3 located on part of the spongy fiber tissue 2, for example, on a curved side surface of the spongy fiber tissue 2. Fluffy fibers 4 project from part (for example, the whole surface) of a surface of the spongy fiber tissue 2.

The cut stem according to the embodiment preferably has a water content of 3 to 15% by weight.

The inventors of the present invention performed various experiments on rod-like stem material, and found that fluffing up the spongy fiber tissue derived from internal tissue was effective for increasing the filling capacity of the cut stem. This is because tobacco shreds wrapped by paper contact one another, and generate resilience to maintain the form as a cigarette. Thus, the tobacco material in a cigarette can be reduced, while hardness of the roll is maintained, by increasing the number of points where the shreds contact one another or the wrapping paper contacts the shreds. The contact points can be increased by fluffing up the spongy fiber tissue of the rod-like stem material, being a wood-based material, as described above.

Next, a method of manufacturing cut stem according to the embodiment will be explained hereinafter.

(First Step)

Rod-like stem material having a water content of 25 to 50% by weight is prepared, and the rod-like stem material is torn. In this treatment, the thickness of the rod-like stem material can be reduced more than that obtained by the existing spread treatment, by mutual action between the water content of the rod-like stem material and the tearing force. Simultaneously, the integument on the surface of the internal tissue of the rod-like stem material is broken, and the internal tissue projects in a fluffy state from the broken integument. The fluffs are formed of fibers of the internal tissue.

Figure 2:
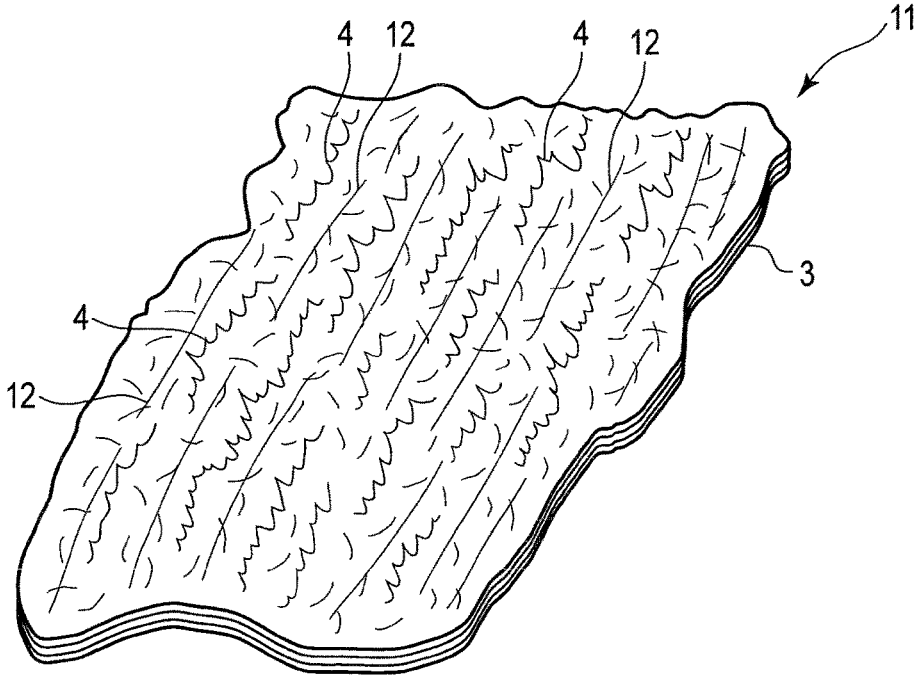
FIG. 2 is a schematic perspective view of rod-like stem material after a tearing step in the manufacturing of cut stems according to the embodiment.

FIG. 2 illustrates the torn rod-like stem material. In the rod-like stem material 11, the integument 3 is broken, and fluffy fibers 4 of the internal tissue project from broken parts 12.

The rod-like stem material having a water content less than 20% by weight may be crushed. On the other hand, the rod-like stem material having a water content exceeding 50% by weight has increased flexibility due to an increase in water retaining amount, and may become difficult to tear. By adjusting the water content of the rod-like stem material to 20 to 50% by weight, the rod-like stem material has increased tearability, and fluffing of the internal tissue is promoted by breaking the integument of the surface of the internal tissue. A more preferable water content of the rod-like stem material is 25 to 40% by weight.

The tearing force is preferably 500 kPa or more.

(Second Step)

The torn rod-like stem material is subjected to shredding treatment. In this treatment, the torn rod-like stem material has a small thickness, and thus cut wastes and eyelet shreds in shredding can be reduced. The rod-like cut stem materials (rod-like cut stem material) are elongate, and have a shape close to that of stripped shreds used for tobacco shreds. In addition, the rod-like cut stem materials include a spongy fiber tissue, which is derived from the internal tissue and includes the integument existing on part of the surface thereof, and fluffy fibers formed on at least part of the surface of the spongy fiber tissue excluding the integument.

Prior to shredding, the torn rod-like stem material is allowed to be humidified, to adjust the water content thereof to, for example, 20 to 50% by weight.

(Third Step)

The rod-like cut stem materials are dried by, for example, superheated steam, and subjected to expansion treatment. In this treatment, each of the rod-like cut stem materials include a spongy fiber tissue, which is derived from the internal tissue and includes the integument existing on part of the surface thereof, and fluffy fibers formed on at least part of the surface of the spongy fiber tissue excluding the integument, as described above. Specifically, the whole surface of the rod-like cut stem material is not covered with the integument, but the integument exists on part of the surface thereof, and fiber tissue derived from the internal tissue is exposed. Thus, the rod-like cut stem materials are promptly and easily expanded by drying with superheated steam. The fluffy fibers and superheated steam promote expansion of the rod-like cut stem materials. As a result, cut stem having a shape as illustrated in FIG. 1 can be manufactured with increased filling capacity.

The rod-like cut stem materials may be dried by using heated air stream instead of superheated steam flow.

In addition, it is allowed to subject the rod-like cut stem materials to humidification using saturated aqueous vapor or wetting and swelling prior to expansion treatment. In the humidification or wetting and swelling treatment, the rod-like cut stem material is highly permeable to saturated aqueous vapor, and uniformly humidified, or wet and swollen, since the spongy fiber tissue derived from the internal tissue is exposed and fluffy fibers are formed on at least part of the surface of the fiber tissue. As a result, the wet rod-like cut stem materials are expanded excellently and uniformly in the drying with superheated steam, and thus cut stems with further increased filling capacity are manufactured. The humidification or wetting and swelling treatment is preferably performed such that the rod-like cut stem materials have a water content of 15 to 50% by weight.

Next, a cut stem manufacturing apparatus according to the embodiment will be explained hereinafter with reference to FIG. 3.

First and second rollers 31 and 32 have the same diameter and length, and driving axes 33 and 34 which rotate in connection with a motor (not shown) are rotatably attached to the centers of the rollers 31 and 32, respectively. The first and second rollers 31 and 32 are arranged to be opposed to each other such that they are aligned in a horizontal direction. The first roller 31 on the left is rotated in a clockwise direction, and the second roller 32 is rotated in a counter-clockwise direction. Specifically, the first and second rollers 31 and 32 are rotated in a feed direction. A plurality of cogs 35 and 36 are formed on outer peripheral surfaces of the first and second rollers 31 and 32, respectively, along the driving axes 33 and 34, respectively. The cogs 35 and 36 are arranged at desired intervals. When the driving axes 33 and 34 of the first and second rollers 31 and 32 are rotated by the motor, the first roller 31 is rotated at a peripheral velocity greater than that of the second roller 32. Scrapers 37 and 38 are arranged in contact with lower parts of the first and second rollers 31 and 32, respectively, to remove machined scraps and tobacco components adhering to the first and second rollers 31 and 32. Water may be sprayed onto the first and second rollers 31 and 32, to wash away machined scraps and tobacco components adhering to the first and second rollers 31 and 32, in cooperation with the scrapers 37 and 38.

The material supplying device, for example, a vibrating feeder 39, is disposed above the first and second rollers 31 and 32. A bottom part at a distal end of the vibrating feeder 39 is provided with an outlet 40 to supply rod-like stem material having a water content of 20 to 40% by weight to a space between the first and second rollers 31 and 32 from above.

A first conveyer 41 is disposed below the first and second rollers 31 and 32, and conveys the rod-like stem materials fed from the first and second rollers 31 and 32 into a cutter 42. A publicly-known device, such as a rotary drum cutter, can be used as the cutter 42.

The cutter 42 is connected to expansion means, for example, an air-stream drier 44, by a second conveyer 43. The second conveyer 43 conveys the rod-like cut stem materials from the cutter 42 to the air-stream drier 44.

Next, a cut stem manufacturing method using the above cut stem manufacturing apparatus illustrated in FIG. 3 will now be explained.

First, rod-like stem material having a water content of 20 to 50% by weight is prepared, and rod-like stem materials 51 are supplied from the vibrating feeder 39 to a space between the rotating first and second rollers 31 and 32. Since the first roller 31 rotates at a peripheral velocity greater than that of the second roller 32, a large tearing force is applied to the rod-like stem materials passing through the space between the first and second rollers 31 and 32. Thus, the rod-like stem materials 51 are torn up, and the thickness of the rod-like stem materials is more reduced in comparison with the existing rolling treatment, by interaction between the water content of the rod-like stem materials and the tearing force. Simultaneously, the integument on the surface of the internal tissue of the rod-like stem materials 51 is broken as illustrated in FIG. 2, and the spongy internal tissue is fluffed up and projects. The torn rod-like stem materials 52 fall onto the first conveyer 41 located below the first and second rollers 31 and 32.

The ratio of the peripheral velocity of the first roller 31 to the peripheral velocity of the second roller 32 is preferably 1.2:1 to 5:1. When the ratio of the peripheral velocity of the first roller 31 to the peripheral velocity of the second roller 32 is less than 1.2, it is difficult to apply sufficient tearing force to the rod-like stem materials. On the other hand, the ratio of the peripheral velocity of the first roller 31 to the peripheral velocity of the second roller 32 exceeding 5 may have adverse influence on breakage of the materials and on the devices. A more preferable ratio of the peripheral velocity of the first roller 31 to the peripheral velocity of the second roller 32 is 2:1 to 4:1.

The torn rod-like stem materials 52 on the first conveyer 41 are conveyed to the cutter (for example, rotary drum cutter) 42, and shredded therein. In shredding, since the torn rod-like stem materials have small thickness and the spongy fiber tissue derived from the internal tissue is exposed, generation of shreds (commonly known as "eyelets") in a state of being surrounded by the integument and cut wastes is reduced, even when the rod-like stem materials are shredded at right angles to the axial direction of the rod-like stem materials. Eyelets and cut wastes prevent a winch from stably operating when cigarettes are manufactured, and cause difficulties, such as unstable hardness of cigarettes and increase in ventilation resistance in smoking. Thus, it is desired to avoid generation of eyelets or cut wastes as much as possible.

In addition, the rod-like cut stem materials are elongate, and have a shape close to stripped shreds used for tobacco shreds. Besides, the rod-like cut stem materials have spongy fiber tissue derived from internal tissue, which includes an integument existing on a part of a surface thereof, and fluffy fibers formed on at least part of the surface of the fiber tissue excluding the integument.

The rod-like cut stem materials are conveyed to the expansion means (such as air stream drier) 44 by the second conveyer 43. The rod-like cut stem materials contact superheated steam while moving through the air stream drier 44, and thereby are dried and subjected to expansion treatment. The rod-like cut stem materials have fiber tissue and fluffy fibers as described above, and are thus promptly and easily expanded by drying with superheated steam. In addition, the fluffy fibers and superheated steam promote expansion of the rod-like cut stem materials. As a result, cut stems with increased filling capacity, having the shape as illustrated in FIG. 1, are manufactured.

The rod-like cut stem materials may be dried by circulating heated air stream, instead of superheated steam stream, in the air-stream drier.

The inventors of the present invention conducted an experiment of taking out more shreds from rod-like stem materials by using a beater called a refiner, and fluffing up the fiber tissues. As a result, at the initial stage of operation, cut stems having a good quality and suitable for the purpose were obtained. With the lapse of time, however, tar derived from the tobacco materials adhered to the disk-shaped fixed blade and the rotary blade, and it was difficult to stably obtain cut stems for a long time.

In view of the result of the above experiment, the inventors of the present invention diligently continued experiments, and found that more shreds are taken out of rod-like stem material, and the spongy fiber tissue is fluffed up, while cut wastes and tar are removed, by tearing the rod-like stem material with two rollers having different peripheral velocities.

Figure 3:
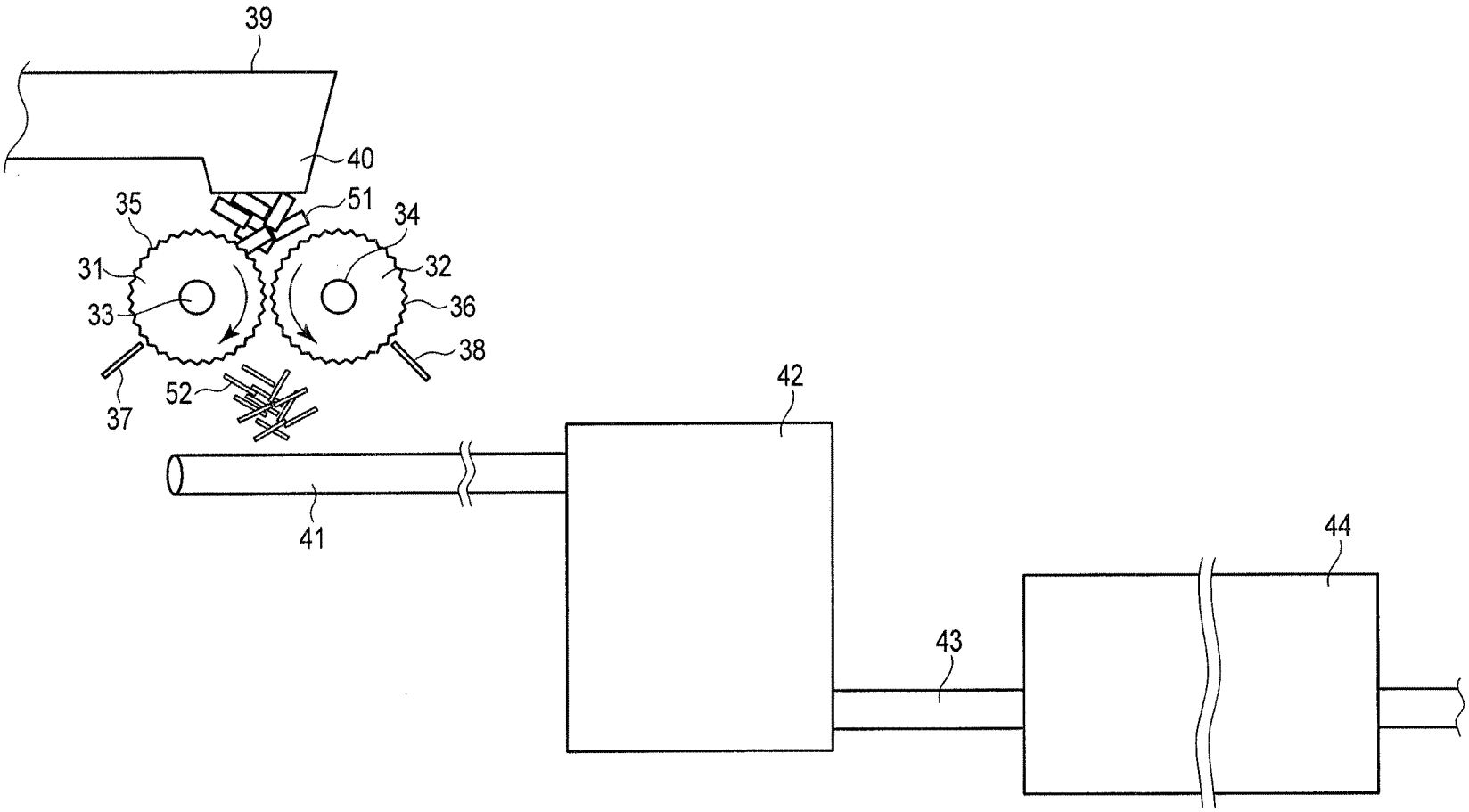
FIG. 3 is a schematic diagram illustrating a cut stem manufacturing apparatus according to the embodiment.

Although the first and second rollers 31 and 32 in which the cogs 35 and 36 extend on the outer peripheral surfaces in the direction of the driving axes 33 and 34 are used in FIG. 3, the embodiment is not limited to this. For example, first rollers 31' and 32' in which a plurality of grooves 45 and 46 are formed in the outer peripheral surfaces to extend in the axial direction may be used, as illustrated in FIG. 4(A).

In addition, first and second rollers 31" and 32" which have smooth outer peripheral surfaces may be used, as illustrated in FIG. 4(B). However, from the viewpoint of applying a large tearing force to the rod-like stem material, it is preferable to use the first and second rollers 31 and 32 having the cogs 35 and 36 illustrated in FIG. 3, or the first and second rollers 31' and 32' having the grooves 45 and 46 as illustrated in FIG. 4(A).

The outer peripheral surfaces of the first and second rollers 31' and 32' (or 31" and 32") are opposed to each other with a fixed space therebetween, as illustrated in FIGS. 4(A) and (B).

Although the first and second rollers 31 and 32 having the same diameter and length are used in FIG. 3, the present embodiment is not limited to this. For example, the first roller may have a diameter greater than the diameter of the second roller, or the first roller may have a diameter smaller than the diameter of the second roller.

The cut stem manufacturing apparatus according to the embodiment allows itself to further comprise humidifying means which humidifies the rod-like cut stem materials, or wetting and swelling means which wets or swells the rod-like cut stem materials between the cutter 42 and the expansion means (such as air stream drier) 44. Saturated aqueous steam is used for these means. The rod-like cut stem materials after being humidified or wet or swollen by these means preferably have a water content of 15 to 50% by weight.

As explained above, according to the present embodiment, a cut stem having increased filling capacity is provided.

In addition, according to the embodiment, a method which enables easy manufacturing of cut stems with increased filling capacity is provided.

Further, according to the embodiment, an apparatus having a simple structure which enables manufacturing of cut stems with increased filling capacity is provided.

Examples of the present invention will be explained hereinafter with reference to FIG. 3.

EXAMPLE 1

Flue-cured rod-like stems (water content: 26% by weight) made in Brazil were prepared as the rod-like stem material.

Rollers having the following shapes and peripheral velocities were used as the first and second rollers 31 and 32 in FIG. 3.

Roller width; 400 mm,

Roller diameter; 300 mm,

Cogs on outer peripheral surface of the roller; 8 cogs per inch,

Height of cogs: 1 mm,

Interval between the rollers (interval between the tops of the cogs of the first roller and the tops of the cogs of the second roller); 0.7 mm, First roller 31: 120 rpm, peripheral velocity of 113 m/minute, Second roller 32; 60 rpm, peripheral velocity of 56.5 m/minutes.

First, the flue cured rod-like stems made in Brazil were supplied from the vibrating feeder 39 to the space between the first and second rollers 31 and 32 rotating under the above conditions at a speed of 300 kg/hr. The flue cured rod-like stems were torn while passing through the first and second rollers 31 and 32.

The torn flue cured rod-like stems were made to fall from the space between the first and second rollers 31 and 32 onto the first conveyer 41, conveyed to the rotary drum cutter 42 by the first conveyer 41, and shredded therein to form flue cured rod-like cut stems having a width of 0.2 mm. The flue cured rod- like cut stems were humidified by saturated aqueous steam from a humidifier (not shown) to have a water content of 38% by weight. The humidified flue cured rod-like cut stems were conveyed to the air stream drier 44, in which a superheated steam stream at a temperature of 240° C. was circulated through the second conveyer 43. It took eight seconds to convey the humidified and flue cured rod-like cut stems into the air stream drier 44, and dry them therein, thereby expanded cut stems were manufactured.

EXAMPLE 2

Figure 4:
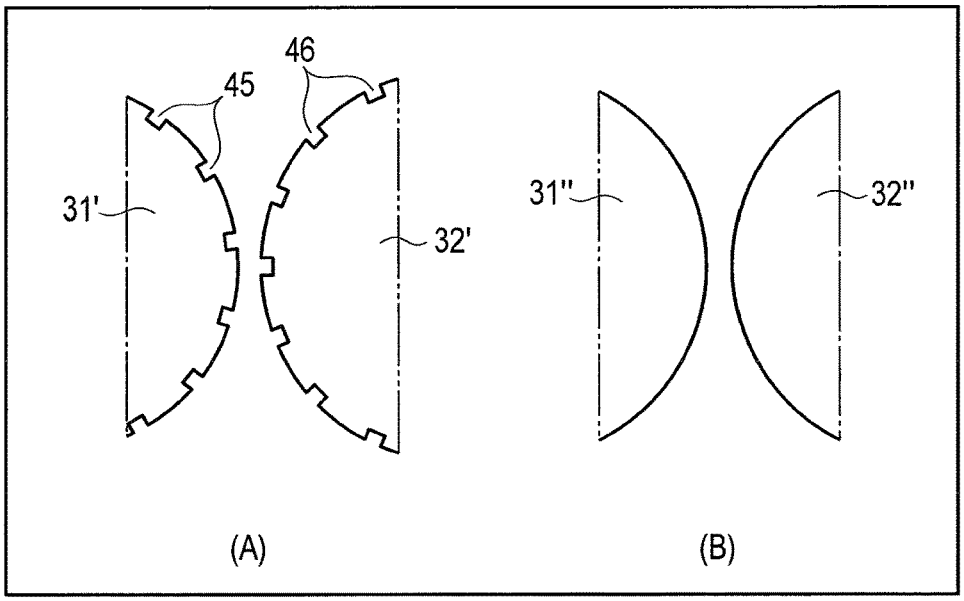
FIG. 4 is a partially cut-away front view illustrating another form of first and second rollers used for the cut stem manufacturing apparatus according to the embodiment.

Expanded cut stems were manufactured by a method similar to Example 1, except that the first and second rollers 31' and 32' illustrated in FIG. 4 had the following shape and peripheral velocities.

Roller width; 400 mm,

Roller diameter; 300 mm,

Grooves in outer peripheral surface of the roller; 1 groove per inch,

Depth of groove: 0.5 mm,

Interval between the rollers (interval between their outer peripheral surfaces); 0.7 mm, First roller 31: 120 rpm, peripheral velocity of 113 m/minute, Second roller 32: 60 rpm, peripheral velocity of 56.5 m/minute.

COMPARATIVE EXAMPLE 1

Expanded cut stems were manufactured by a method similar to Example 1, except that the flue cured rod-like stems (water content: 26% by weight) made in Brazil were spread by a pair of rollers which are opposed with an interval of 0.8 mm and the equal velocity of 60 rpm, instead of tearing the rod-like stems by the first and second rollers 31 and 32.

About 2 g of the obtained expanded cut stems of Examples 1 and 2 and Comparative Example 1 were put into weighing bottles, and dried for one hour in a natural-convection oven at a temperature of 100° C. Thereafter, the filling capacity thereof was calculated from the difference in weight between undried and dried stems, and obtained as an average value of five points. As a result, the water content of the expanded cut stems of Examples 1 and 2and Comparative Example 1 was 12% by weight, 12% by weight, and 12% by weight, respectively.

Figure 5:
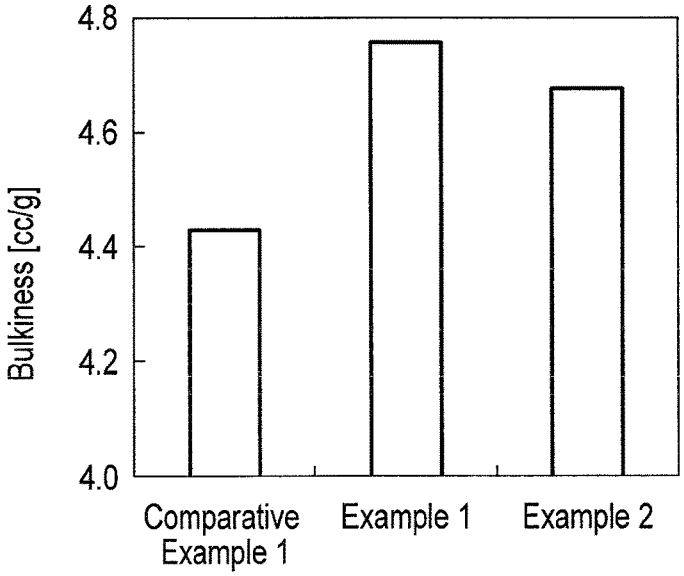
FIG. 5 is a diagram illustrating the filling capacity of cut stems obtained by Examples 1 and 2 and Comparative Example 1.

In addition, the expanded cut stems of Examples 1 and 2 and Comparative Example were stored (harmonized) for one week in a temperature and humidity testing chamber held at a temperature of 22.0° C. and relative humidity of 60%, to equalize the moisture content, and thereafter the filling capacity of each of them was measured. FIG. 5 illustrates the result of the measurement.

The filling capacity indicates the filling capacity thereof when the tobacco shreds were processed into a smokable wrapped state. DD-60A manufactured by Borgwaldt, which is a German company, was used for the measurement. In the test, filling capacity of the expanded cut stems was measured five times, and an average value thereof was calculated.

As is clear from FIG. 5, the expanded cut stems of Examples 1 and 2 obtained by tearing flue cured rod-like stems made in Brazil and subjecting them to shredding and expansion treatments exhibited a filling capacity of 4.76 cc/g and 4.68 cc/g, respectively, and proved to have increased filling capacity in comparison with that (4.48 cc/g) of the expanded cut stems of Comparative Example 1 obtained by spreading the flue cured rod-like stems and thereafter subjecting them to shredding and expansion treatments.

What is claimed is:

1. A cut stem manufacturing method comprising:

tearing a rod-like stem material having a water content of 20 to 50% by weight;

shredding the torn rod-like stem material; and subjecting the rod-like cut stem material to expansion treatment, wherein the rod-like stem material is torn by passing the rod-like stem material between two rollers rotating in opposite directions at different speeds.

2. The cut stem manufacturing method according to claim 1, further comprising:

wetting and swelling the rod-like stem material after the shredding and before the subjecting the expansion treatment.

3. The cut stem manufacturing method according to claim 2, wherein the wetting and swelling is performed such that the rod-like stem material has a water content of 15 to 50% by weight.

4. The cut stem manufacturing method according to claim 1, further comprising humidifying the torn rod-like stem material before shredding.

5. The cut stem manufacturing method according to claim 4, further comprising humidifying the shredded rod-like stem material before expansion.

6. The cut stem manufacturing method according to claim 1, further comprising humidifying the shredded rod-like stem material before expansion.

* * * * *